United States Patent [19]

Mayer

[11] Patent Number: 4,944,661

[45] Date of Patent: Jul. 31, 1990

[54] ELECTRO-MAGNET ACTUATED FUEL PISTON PUMP

[75] Inventor: Wolfgang Mayer, Esslingen, Fed. Rep. of Germany

[73] Assignee: J. Eberspächer, Esslingen, Fed. Rep. of Germany

[21] Appl. No.: 168,682

[22] Filed: Mar. 16, 1988

[30] Foreign Application Priority Data

Mar. 11, 1987 [DE] Fed. Rep. of Germany ..... 3707764

[51] Int. Cl.[5] ..... F02M 59/46; F04B 17/04

[52] U.S. Cl. ..... 417/501; 417/417; 417/569

[58] Field of Search ..... 417/501, 417, 569, 499, 417/494

[56] References Cited

U.S. PATENT DOCUMENTS 2,612,841 10/1952 Lasley ..... 417/501

4,314,797 2/1982 Gerwin ..... 417/418

*Primary Examiner*—Leonard E. Smith

*Attorney, Agent, or Firm*—McGlew & Tuttle

[57] ABSTRACT

An electromagnetically-actuated fuel piston pump is constructed so as to eliminate the distracting pumping noises occurring during the functioning by using a dampening elastic element arranged at a site protected against contact with the delivered fuel by seals. The seals accomplish a bearing of the cylinder, which simplifies the fabrication.

8 Claims, 1 Drawing Sheet

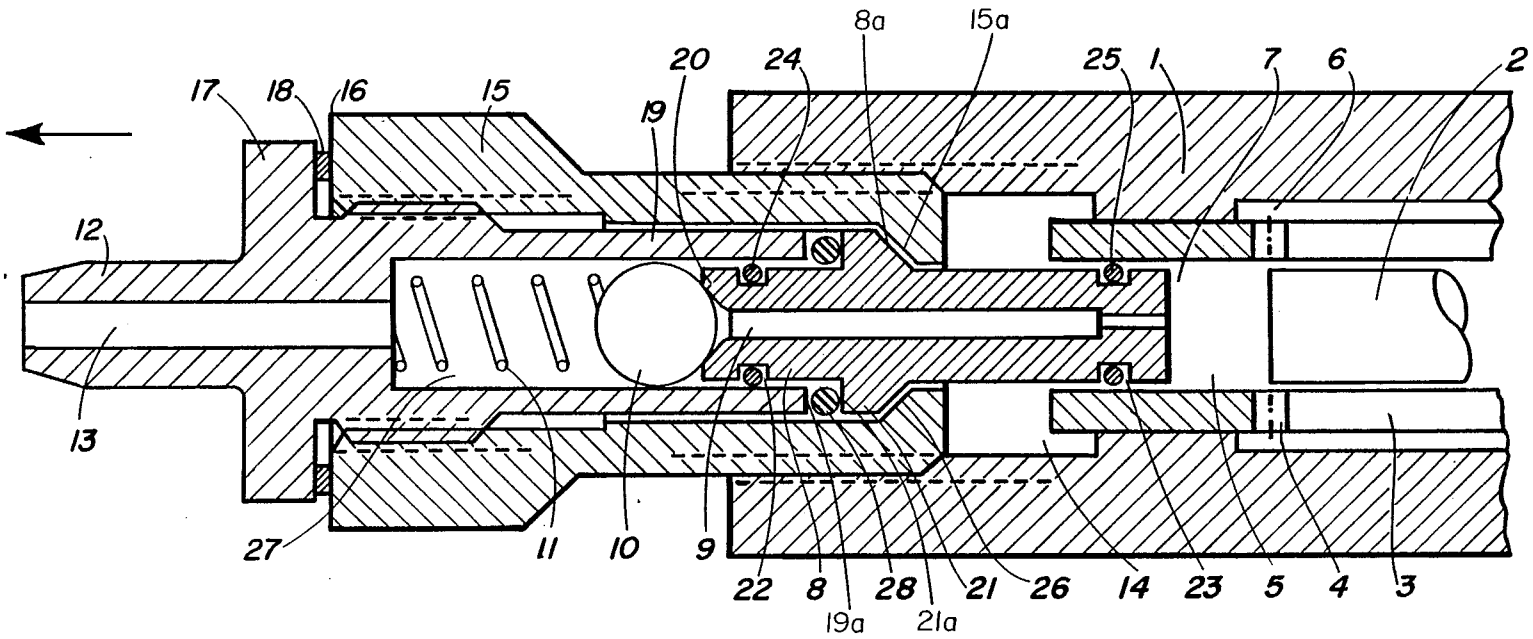
2
6
7
1
25
15a
8a
24
20
19
15
16
18
17
12
3
4
5
23
14
26
21
21a
28
19a
8
22
9
10
11
27
13

ELECTRO-MAGNET ACTUATED FUEL PISTON PUMP

BACKGROUND OF THE INVENTION

Field of the Invention

This invention relates, in general, to the construction of fuel pumps and, in particular, to a new and useful electromagnetically operated fuel piston pump having an improved sealing arrangement.

The invention particularly refers to an electromagnetactuated fuel piston pump, especially for heating equipment operating on liquid fuel, in which an electromagnetically reciprocating piston delivers the fuel from a cylindrical space through a bore arranged in a cylinder, and at the downstream end of the cylinder there is a spring-loaded pressure valve, followed by a pressure pipe joint further downstream.

Such fuel piston pumps are used preferably for small heating appliances, suitable for installation in motor vehicles, or for small stationary heating layouts.

Fuel piston pumps of a similar kind are already known. Thus, German patent No. 23 15 842 describes a fuel piston pump of this category, in which the fuel is delivered by piston, driven back and forth by an electromagnet, from a cylindrical space into the bore of a pressure pipe joint. In this familiar arrangement, at the end of each stroke the piston strikes against the pressure pipe joint, resulting in a loud knocking noise. The metallic connection of the pressure pipe joint to the pump housing amplifies the emission of the noise, which is very distracting.

Efforts to dampen the disturbing knocking noises by an acoustic separation of the structural components have produced no satisfactory result. There has also been an attempt to reduce the noise by arrangement of an elastic stop plate on the end of the cylinder facing the cylindrical space and, consequently, the piston. However, it turned out that the known materials are not resistant to the delivered fuel, but instead swell up or even dissolve.

SUMMARY OF THE INVENTION

The invention provides a fuel piston pump, which operates almost noiselessly and with safe and reliable delivery of relatively small quantities of liquid fuel, and which is relatively simple in construction.

According to the invention, an elastic element is arranged between a pressure pipe joint and a cylinder in the fuel piston pump, the cylinder having an enlarged diameter of the downstream end to carry this element. The pressure pipe joint has an annular neck, protruding into the valve housing and overlapping the downstream end of the cylinder, in order to fix the position of the element.

In order to prevent the elastic dampening element from coming into contact with the delivered substance, furthermore, the invention arranges a sealing element in front of and behind the elastic element. Placing the sealing elements with the largest possible separation from each other, according to a further provision of the invention, produces the additional advantage for the fabrication of the fuel piston pump that the precision of the fitting between the cylinder and valve housing and between cylinder and piston bushing is not so demanding, i.e., larger tolerances are possible, since a slight tilting of the cylinder can be offset by the sealing elements. By the same token, the preferably conical sealing sites between cylinder and valve housing can be kept very small, with a perfectly satisfactory seal.

It has been found that the dampening of the noise is largely dependent on the elasticity of the elastic element and the bearing pressure exerted on the element. With little bearing pressure, the dampening decreases, and with increasing bearing pressure the elastic element behaves increasingly as a rigid element, thereby losing its dampening ability. According to a further provision of the invention, therefore, the pressure pipe joint with annular neck is arranged in the valve housing adjustably along its longitudinal axis, in order to regulate the bearing pressure on the elastic element. In this way, the noise dampening can be optimized. The optimal bearing force can be set, at very least, during the start-up of each production series. This measure also provides the effective distance between the flange of the pressure pipe joint and the upper closing surface of the valve housing and, thereby, the thickness of a spacing ring to be introduced between this flange and the closing surface.

In order to accomplish even better protection against conduction of impact noise, according to a further provision of the invention, the cylinder and/or the valve housing is formed of a material with slight conductance of solid-borne sound. Plastics have proved to be suitable, which also have sufficient resistance to the fuel being delivered, if necessary, by applying a fuel-resistant material to the surface coming into contact with the fuel. This configuration has the further advantage that the fuel piston pump becomes even lighter. In conjunction with the dampening elastic element, an almost noiseless fuel piston pump can be made in this way.

Accordingly, it is an object of the invention to provide a fuel pump which is preferably an electromagnetically operated fuel piston pump with a construction which permits operation without noise and which includes improved sealing elements insuring accurate and quiet operation.

A further object of the invention is to provide a fuel pump which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWING

The only FIGURE of the drawing is a partial axial sectional view of an electromagnetically operated fuel pump constructed in accordance with the invention.

DESCRIPTION OF THE PREFERRED EMBODIMENTS

Referring to the drawings, in particular, the invention embodied therein comprises a fuel pump having a pump housing generally designated 1 with a cylinder space 5 having a piston 2 movable in the space to pump fuel. A tubular seating cylinder member 8 is positioned within said housing and has a fuel delivery bore 9 extending therethrough and it is positioned with a first end extending into the cylinder space and has an opposite second end with a valve seat 20 formed around the delivery bore 9. The seating member 8 also has an intermediate portion of wider diameter than the remaining portion which forms an abutment ledge 21*a*. Pump housing 1 is connected by a valve housing portion 15 with an interior collar 15*a* which engages around and forms a seating for a front side 8*a* of the enlarged diameter portion 21. The housing portion 15 has an opposite annular end which forms a closing surface 16.

A pressure pipe joint member 12 is threadably engaged into the housing portion 15 and pipe joint member 12 has an annular neck extending over a portion of the seating member 8. This neck terminates in an annular sleeve edge 19*a* which faces the shoulder abutment 21*a*. Of enlarged diameter portion.

The pressure pipe joint member 12 has an interior bore 13 and an enlarged space 27 which define a fuel delivery passage which is communicatable with fuel delivery bore 9. The springloaded valve including a ball valve element 10 and a spring 11 is arranged in the space 27 and closes the valve seat 20. The pressure pipe joint member 12 has an annular shoulder 17 which is spaced from the housing portion annular closure surface 16 and a spacer ring 18 is arranged therebetween. An elastic element 28 is disposed between the annular sleeve edge 19*a* and the ledge 21*a*. In addition, sealing means are arranged both upstream and downstream from this elastic element 28 and comprise resilient Orings 25 and 24, respectively.

The drawing shows the pressure end of the pump housing 1 of a fuel piston pump with a the piston 2, guided in a bushing 3, moving back and forth by an electromagnetic drive (not shown). The piston bushing 3 has overflow openings 4, providing a connection between the cylinder space 5 in front of the piston 2 and an overflow channel 6, through which the fuel can flow during the delivery until the piston closes off the overflow openings 4. Hence, the size of the cylindrical space 5 determines the quantity of fuel delivered. During the delivery of the fuel from the cylindrical space 5, the piston 2 acts on the lower closing surface 7 of the seating member 8, which has the fuel delivery bore 9. This fuel delivery bore 9 is closed off downstream by a spring-loaded valve with movable valve 10, acted upon by a valve element spring 11, until the delivery pressure is able to open the pressure movable valve element 10. A pressure pipe joint 12 is the next element of the pump 1 and valve housing 1 downstream. The bore 13 of the pump housing delivers the fuel. The valve housing 15 protrudes into the pump housing 1 in a corresponding recess 14, and is provided with a threading to receive a discharge pipe or pressure pipe joint 12. Between the upper closing surface 16 of the valve housing 15, and a flange 17 of the pressure pipe joint 12, according to the invention, there is arranged a spacer ring 18. The pressure pipe joint 12 has an annular neck 19 which protrudes into the valve housing 15 and is guided therein. The pressure valve 10, accommodated inside the annular neck 19, is pressed against the valve seat 20 of the seating member 8 by means of the valve spring 11.

The seating member 8, according to the invention, has an enlarged diameter portion 21, so that an elastic element 28, stipulated by the invention, can be arranged between the shoulder 21*a* formed by this portion and the edge 19*a* of the annular neck 19 of the pressure pipe joint 12. Furthermore, at the widest possible separation, the seating member 8 has grooves 22 and 23 to accommodate sealing rings 24 and 25, respectively, with sealing ring 25 being upstream and sealing ring 24 downstream from the elastic element 28, so that the latter is protected against contact with the delivered substance. The sealing ring 24 keeps out fuel from the pressure valve space 27 and the sealing ring 25 keeps out fuel from the cylinder space 5. By virtue of the fact that the sealing rings 24 and 25 are arranged with the largest possible spacing from each other, tilting of the cylinder can be prevented and it also provides a reliable seal at the sealing site 26 between cylinder 8 and valve housing 15.

During the operation of the fuel piston pump, the piston 2 moves toward the lower closing surface 7 of the seating member 8 to deliver the fuel which has been admitted and which flows both through the overflow openings 4 and the overflow channel 6 and also into the cylinder space 5. Knocking noises, usually arising from this process without the inventive construction, are dampened by the elastic element 28. Optimal damping can be adjusted by suitable bearing force on the elastic element 28, whereby the pressure pipe joint 12 is moved closer to or further from the element 28. The optimal setting can be gauged to the distance between the flange 17 and the upper closing surface 16 of the valve housing 15 and accomplished during the subsequent assembly of a production series by installing a spacer ring 18 of the appropriate thickness. The dampening elastic element 28 is protected against the fuel being delivered past the sealing elements 24 and 25, which are preferably 0-rings, and the element 28 is protected against swelling and a relatively cheaper material can be selected, even one that does not become hard when cold. Such relatively cheap materials are especially prone to swelling upon exposure to fuel, and under the influence of cold could become hard and therefore unsuitable. The dual bearing of the seating member 8 has the further advantage that the sealing elements 24 and 25 offset the tilting of the seating member 8, so that the requirements for the tolerances of the cylinder 8 are more moderate than those of the familiar arrangements. This results in a simplification of the fabrication, and the sealing site 25 can be kept small, which also results in a simplification in the fabrication and higher operating safety with full satisfactory seal.

Both the cylinder 8 and the valve housing 15 can be made of material with poor conductance of impact noise. Plastic, e.g., is suitable for this purpose, if necessary, with a fuel-resistance surface.

What is claimed is:

1. An electromagnetic actuated fuel piston pump for heating equipment which operates on liquid fuel, comprising: a housing defining a cylinder space and defining a valve space; an electromagnetically reciprocating piston movable in said cylinder space; a seating member arranged within said housing in alignment with said cylinder space, said seating member having a delivery bore therethrough extending from a first end adjacent said cylinder space to a second end in said valve space, said valve space and said seating member including means for restricting movement of said seating member in the direction of said piston; a spring-loaded pressure valve engageable with a valve seat of said seating member; a pressure pipe joint forming an extension of said housing, said pressure pipe joint including an annular neck extending into said housing surrounding said spring-loaded pressure valve; a first sealing element for sealing in between a surface defining said cylinder space and said seating member adjacent said seating member first end; a second sealing element for sealing between said annular neck and said seating member adjacent said seating member second end, and elastic means positioned between a shoulder of said seating member and a sleeve edge of said annular neck of for reducing noise generated during pumping.

2. A fuel pump comprising: a piston; a housing defining a cylinder space, said piston being movable back and forth in said cylinder space, said housing including a valve housing portion; a seating member including a valve seat extending into said valve housing portion, said seating member defining a fuel delivery bore, said seating member having a first end extending into said cylinder space, said valve seat being on a second end opposite said first end, said seating member having an intermediate portion of wider diameter than a remaining portion thereof, said portion of wider diameter forming a shoulder abutment, said portion of wider diameter being positioned in said valve housing portion,; a pressure pipe including an annular neck, said annular neck extending into said housing, said annular neck terminating in an annular neck edge facing said shoulder abutment; a spring loaded valve, positioned in said annular neck portion, said spring loaded valve including a movable valve member biased into engagement with said valve seat; a first sealing element for sealing in between a surface defining said cylinder space and said seating member adjacent said seating member first end; a second sealing element for sealing between said annular neck and said seating member adjacent said seating member second end; and, elastic means positioned between said annular neck edge and said shoulder abutment for reducing noise generated during pumping.

3. A fuel piston pump according to claim 2, wherein said pressure pipe is threadably engaged with said valve housing part and its annular end edge may be adjusted against said elastic elements with varying pressure.

4. A fuel pump according to claim 2, wherein a spacer ring is arranged between a flange of said pressure pipe joint and an upper closing surface of said valve housing.

5. A fuel pump according to claim 2, wherein said pump is electromagnetically operated to move said piston in said cylinder space and wherein said elastic means includes an elastic element protected from contact with delivered fuel by said first sealing means including a first sealing element arranged between said seating member and the interior of said housing adjacent said piston and said second sealing means including a second sealing element arranged between said seating element and said pressure pipe on the opposite side of said elastic element from said piston.

6. A fuel piston pump according to claim 5, wherein said sealing means are arranged with the largest possible separation from each other along the axis of said pump.

7. A fuel piston pump according to claim 5, wherein said seating element comprises a material having slight conductance of solid borne sound.

8. A fuel piston pump according to claim 7, wherein said valve housing comprises a material with slight conductance of solid borne sound.

* * * * *